US006119844A

United States Patent [19]

Ali

[11] Patent Number: 6,119,844

[45] Date of Patent: Sep. 19, 2000

[54] COIN VALIDATION APPARATUS AND METHOD

[75] Inventor: Riaz Ali, Lancashire, United Kingdom

[73] Assignee: Coin Controls Ltd., Oldham, United Kingdom

[21] Appl. No.: 08/930,723

[22] PCT Filed: Apr. 3, 1996

[86] PCT No.: PCT/GB96/00826

§ 371 Date: Dec. 15, 1997

§ 102(e) Date: Dec. 15, 1997

[87] PCT Pub. No.: WO96/31847

PCT Pub. Date: Oct. 10, 1996

[30] Foreign Application Priority Data

Apr. 7, 1995 [GB] United Kingdom ..... 9507257

[51] Int. Cl.[7] ..... G07D 5/08

[52] U.S. Cl. ..... 194/203; 194/317

[58] Field of Search ..... 194/200, 202, 194/203, 317, 318, 319

[56] References Cited

U.S. PATENT DOCUMENTS

| | | | |
|---|---|---|---|
| 4,228,811 | 10/1980 | Tanaka et al. | 194/317 X |
| 4,385,684 | 5/1983 | Sugimoto et al. | 194/318 |
| 4,538,719 | 9/1985 | Gray et al. . | |
| 4,601,380 | 7/1986 | Dean et al. | 194/318 |
| 4,625,851 | 12/1986 | Johnson et al. | 194/200 |
| 4,686,365 | 8/1987 | Meek et al. | 250/281 |
| 4,749,074 | 6/1988 | Ueui et al. | 194/317 |
| 4,754,862 | 7/1988 | Rawicz-Szczerbo et al. | 194/319 |
| 4,845,994 | 7/1989 | Quinlan, Jr. | 73/163 |
| 4,951,800 | 8/1990 | Yoshihara et al. | 194/317 |
| 4,995,497 | 2/1991 | Kai et al. | 194/318 |
| 5,007,520 | 4/1991 | Harris et al. | 194/317 |
| 5,033,603 | 7/1991 | Kai et al. | 194/334 |
| 5,062,518 | 11/1991 | Chitty et al. | 194/317 |
| 5,085,309 | 2/1992 | Adamson et al. | 194/317 |
| 5,155,960 | 10/1992 | Shaanan | 52/884 |
| 5,158,166 | 10/1992 | Barson | 194/319 |
| 5,180,046 | 1/1993 | Hutton et al. | 194/319 |
| 5,226,520 | 7/1993 | Parker | 194/317 |
| 5,379,876 | 1/1995 | Hutton | 194/319 |
| 5,469,952 | 11/1995 | Kershaw et al. | 194/317 |
| 5,489,015 | 2/1996 | Wood | 194/318 |
| 5,515,960 | 5/1996 | Wood | 194/328 |
| 5,657,847 | 8/1997 | Tod et al. | 194/207 |

FOREIGN PATENT DOCUMENTS

| | | |
|---|---|---|
| 0 155 126 A2 | 9/1985 | European Pat. Off. . |
| 0 164 110 A3 | 12/1985 | European Pat. Off. . |
| 0 384 375 A1 | 8/1990 | European Pat. Off. . |
| 0 404 432 A2 | 12/1990 | European Pat. Off. . |
| WO 85 04037 | 9/1985 | WIPO . |

*Primary Examiner*—F. J. Bartuska
*Attorney, Agent, or Firm*—Morgan & Finnegan, L.L.P.

[57] ABSTRACT

A coin validator with an improved coin processing rate, performs primary validation testing on coins at a primary validation station as successive coins roll down a coin rundown path. Unacceptable coins pass to a coin reject path but coins found acceptable by the primary validation testing are deflected by a solenoid operated gate to a coin accept path. The acceptable coins pass a further sensor coil. Auxiliary coin testing is carried out by a microprocessor by analyzing the time taken for the coin to reach and move away form the further sensor. The microprocessor performs undertimer and overtimer routines FIGS. 3A, B and if the coin arrives within the under and overtimer ranges $t_1$, $t_2$, the coin is accepted. When the coin throughput rate is increased, the undertimer is switched off in order to permit the coin throughput rate for valid coins to be increased, without loss of security.

21 Claims, 6 Drawing Sheets

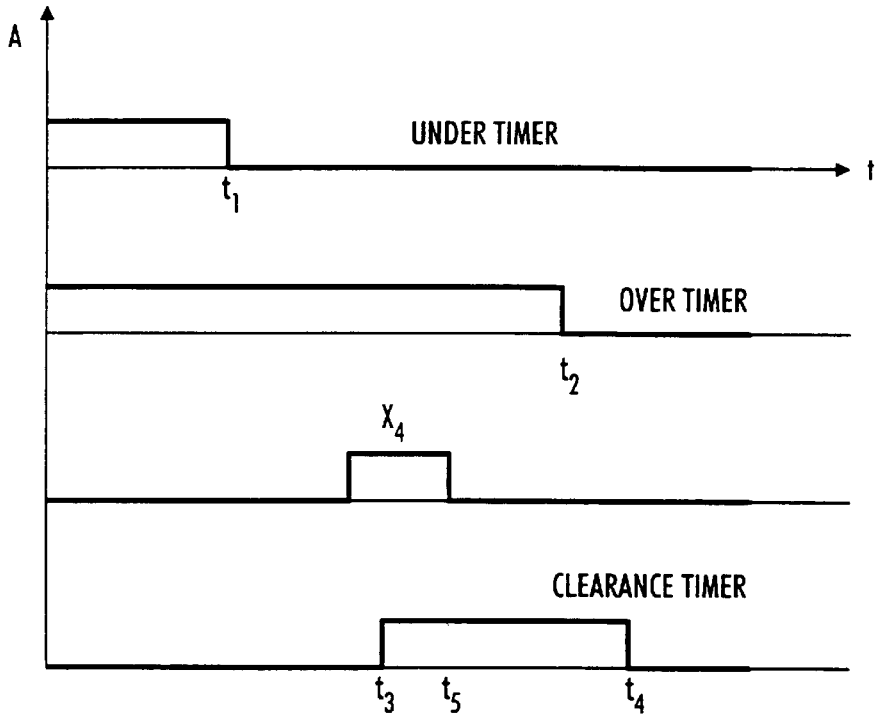
FIG.3A
FIG.3B
FIG.3C
FIG.3D
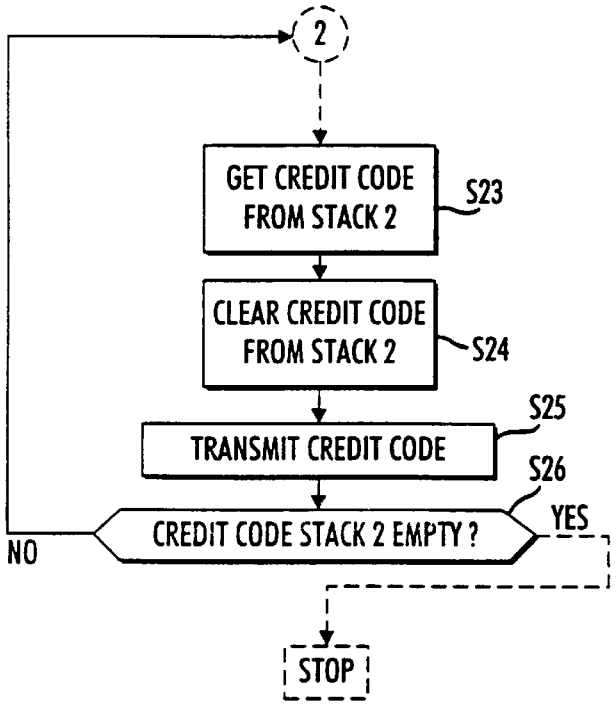
FIG.5C

COIN VALIDATION APPARATUS AND METHOD

FIELD OF THE INVENTION

This invention relates to coin validation apparatus and a method of validating coins.

BACKGROUND

Coin validators which can discriminate between coins of different denominations are well known and one example is described in our UK Patent No. 2 169 429. This coin validator includes a coin rundown path along which coin pass edgewise through a primary sensing station at which coils perform a series of primary inductive tests on the coin to develop coin parameter signals which are indicative of a material and metallic content of the coin under test. The coin parameter signals are compared by a microprocessor with stored data corresponding to the plurality of coins of different denominations. If the coin is found to be acceptable as a result of the primary validation testings, the microprocessor operates an accept gate so that the coin is directed to an accept path. Otherwise, the accept gate remains inoperative and causes the coin to pass to a reject path.

Whilst the primary validation testing can discriminate adequately between true coins of different denominations and fraudulent coins, further auxiliary validation testing is carried out in order to check whether an attempt is being made to defraud the validator by a non-standard fraudulent operation. In the past, frauds have been attempted by lowering a true coin attached to a length of string into the validator so as to trigger a successful outcome during primary validation testing, and then to insert a coin of lower value. The true coin on a string is then withdrawn from the validator for re-use.

In the past, to overcome this problem, an accept sensor has been provided in the accept path and the validator generates a credit code indicating the presence of a true coin, only if the true coin passes the accept sensor within a predetermined time range subsequent to successful primary validation testing. Another possible fraud involves lowering the coin on a string into the vicinity of the further sensor in the coin accept path. However, the timing at which the coin on the string arrives at the sensor usually differs from that for a true coin so that an analysis of the timing relationship of the signals from the primary testing and the auxiliary testing permits discrimination against fraudulent operation performed in this manner.

A problem associated with the auxiliary testing is that it limits the rate at which the primary validation can be carried out on successive coins fed into the validator. Thus, when coins are fed into the validator at a rate that exceeds a given threshold, the primary validation testing carried out on a first coin is followed by auxiliary validation tests thereon, and the auxiliary validation tests may not be completed by the time that the primary validation testing is carried out on the next coin. In order to avoid any risk of fraud, the validator is programmed to reject the second coin even though it may actually be a true coin.

SUMMARY OF THE INVENTION

The present invention provides a solution to this problem. In accordance with the present invention there is provided a coin validation apparatus comprising means defining a passageway to receive coins under test, primary validation testing means for performing primary validation testing on coins passing along the passageway, auxiliary validation testing means for performing at least one auxiliary validation test on the coins additional to the testing carried out by the primary testing means, gate means for directing coins determined to be valid to an acceptance path and coins determined to be invalid to a reject path, control means for controlling operation of the gate means in dependence upon the outcome of the primary and auxiliary validation testing performed by the primary and auxiliary testing means, and means for rendering the control means unresponsive to the outcome of the auxiliary validation test when a succession of coins is fed into the passageway at a rate that exceeds a given threshold.

In accordance with the invention, it has been appreciated that when coins are fed into the coin validation apparatus at a rate that exceeds a certain threshold, it would be practically impossible to attempt to defraud the validator by fraudulent operations such as lowering a coin on a string into the apparatus, because the rate at which coins are passing through the device means that there is no time available to carry out such frauds. Accordingly, it is safe to switch off or disable consideration of at least some of the auxiliary validation testing without any loss of security, with the advantage that the primary validation testing can be performed on successive coins at a higher rate than hitherto.

The invention also includes a method of validating coins, comprising performing primary validation testing on coins passing along a passageway, performing at least one auxiliary validation test on the coins additional to the primary validation testing, directing coins determined to be valid to an acceptance path and coins determined to be invalid to a reject path in dependence upon the outcome of the primary and auxiliary validation testing; and disregarding the outcome of the auxiliary validation test when a succession of coins is fed into the passageway at a rate that exceeds a given threshold.

BRIEF DESCRIPTION OF THE DRAWINGS

In order that the invention may be more fully understood, an embodiment thereof will now be described by way of example with reference to the accompanying drawings and by way of contrast with a prior art validator. In the accompanying drawings:

FIGS. 3A–3D illustrate timing signals developed during operation of the circuit shown in FIG. 2;

FIGS. 5A–5C illustrate a flow diagram for the microprocessor operation in accordance with the present invention.

DETAILED DESCRIPTION

Figure 1:
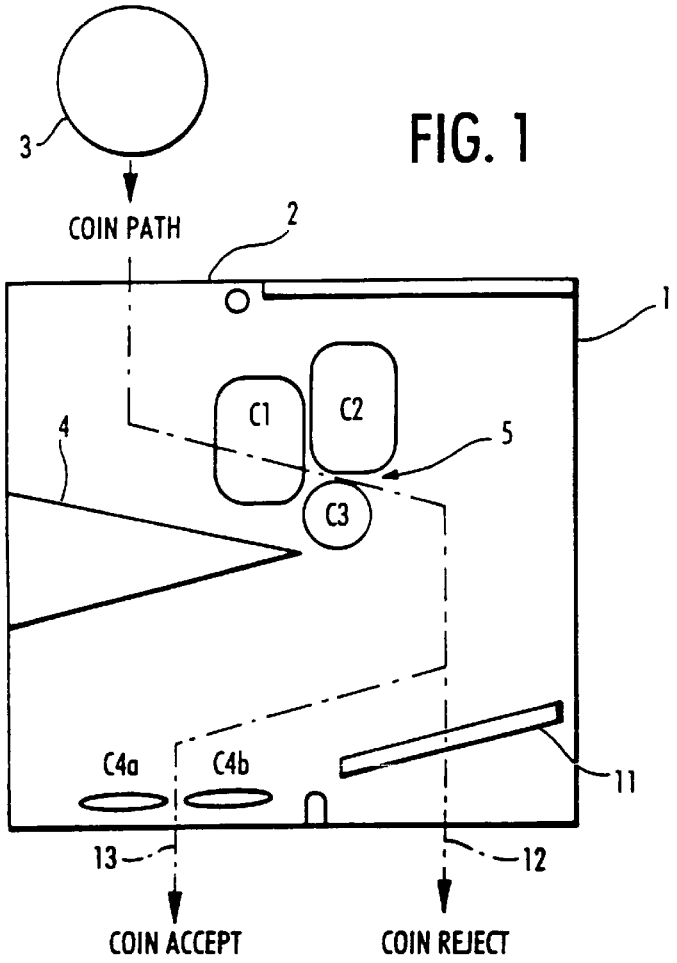
FIG. 1 is a schematic elevational view of a coin validator, showing its coin rundown path.

A coin validator unit is shown in FIG. 1 which consists of a housing 1 having a coin inlet 2 through which coins such as coin 3 shown in dotted outline, fall onto a coin rundown path 4 so as to roll edgewise through a primary coin sensing station 5. Three coils C1, C2, C3, are located at the sensing station 5 in order to carry out a primary coin validation test. The coils are of different sizes and configurations and are each energised to form an inductive coupling with the coin.

Figure 2:
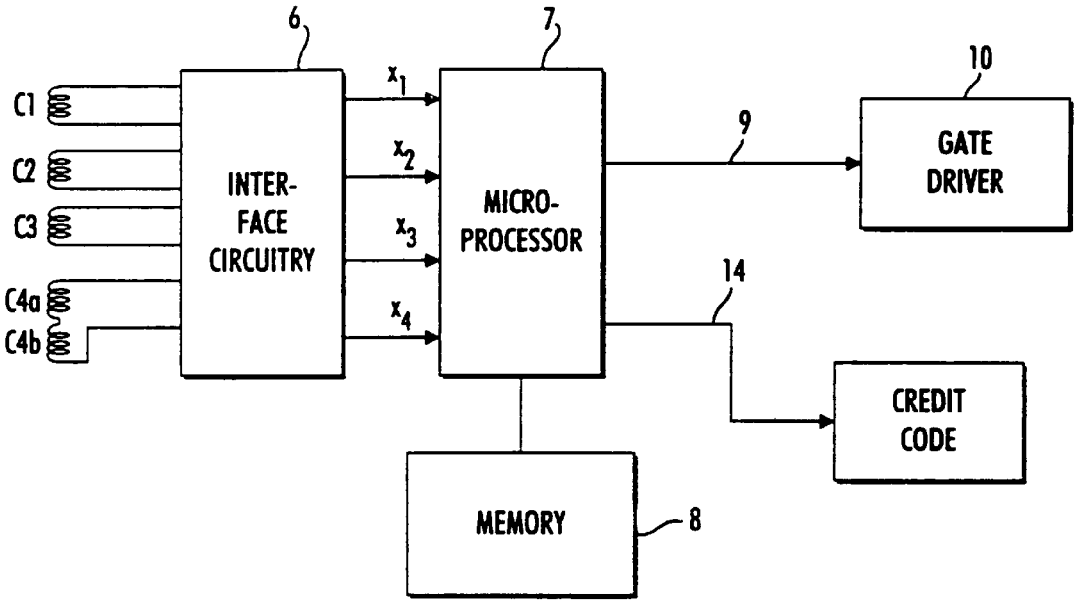
FIG. 2 is a schematic diagram of the circuits of the validator shown in FIG. 1.

As explained in UK Patent No. 2 169 429, the various inductive couplings give rise to impedance changes for the coils which distinctly characterise a coin under test. Referring to FIG. 2, the impedance changes are processed by circuitry 6 to provide coin parameter signals $x_1$, $x_2$, $x_3$ in digital form, which are a function of the impedance changes. The coin parameter signals are fed to a microprocessor 7 to be compared with data stored in a memory 8 corresponding to acceptable coins of different denominations. If the coin is determined by the microprocessor 7 to be acceptable in response to the primary validation test, an output is provided on line 9 to a gate driver 10.

As shown in FIG. 1, an accept gate 11, driven by the driver 10 of FIG. 2, is located at the end of the coin rundown path 4. The gate is normally open in which case, coins travelling along the path 4, fall into a coin reject path 12. However when the gate driver 10 is energised, the gate is closed so as to close the coin reject path 12 and as a result, coins are deflected by the gate 11 to a coin accept path 13. Coin accept sensor coils C4*a*, C4*b* connected in series, are arranged in the entrance of the coin accept path 13. As shown in FIG. 2, the coils C4*a, b* produce a digital coin accept pulse $x_4$ that is fed by the circuitry 6 to the microprocessor 7. The duration of the pulse $x_4$ depends upon the time taken for the coin to traverse the coin sensor coils C4. As will be explained in more detail hereinafter, the coin accept pulse $x_4$ is used by the microprocessor to perform auxiliary validation testing, additional to that performed with the sensor coils C1, C2 and C3. If the microprocessor determines that the coin is acceptable, both from the primary and the auxiliary validation tests, an output credit code is produced on line 14, indicating the presence of a valid coin of a particular denomination.

Whilst the primary validation test performed at sensor station 5 can provide satisfactory discrimination between different denominations of true coins and frauds, it is possible to defraud the validator by performing fraudulent, non-standard operations as will now be explained, and for this reason, the auxiliary tests are used to discriminate further between true coins and frauds. One common type of potential fraud is carried out by inserting a true coin on a length of string into the validator. The coin on the string is lowered through the sensing station 5 and as a result a satisfactory primary validation test is performed by the microprocessor 7. Thereafter, a second coin of lower value may be inserted and the coin on the string is pulled back out of the validator. The successful primary coin validation test causes the gate 11 to be closed so that the second coin is directed into the coin accept path 13, past the coils C4*a, b*. As an alternative to inserting the second coin, the coin on the string may be lowered further so as to be deflected by the gate 11 into the accept path 13, to be detected by coils C4*a, b,* and is then pulled back out of the validator.

In order to avoid frauds of this type, the microprocessor 7 performs auxiliary coin validation tests using the output of the coin accept sensor coils C4 and the state of the drive signal applied on line 9 to the gate driver 10. The credit code on line 14 is only produced if both the primary and auxiliary tests indicate the presence of an acceptable coin.

Prior art auxiliary testing will now be described in more detail. When the microprocessor 7 performs a successful primary validation test in response to a coin at the sensor station 5, the following two steps are carried out by the microprocessor 7. Firstly, the status of the drive signal on line 9 for the gate driver is checked. If this indicates that the gate is open, i.e. in a reject state, this indicates that any previous entered coin has cleared through the validator and that it is ready to accept the coin at the sensor station 5. Secondly, the timing duration of signals developed by the coin accept sensor coils C4*a, b* are analysed to determine the following:

a) coin arrived too early at coil C4;

b) coin arrived too late at coil C4;

c) coin cleared coil C4 too early;

d) coin cleared coil C4 too late.

These four auxiliary coin validation tests seek to distinguish between a true coin falling through the validator and an attempt to defraud the validator by lowering a coin on a string as previously described. When a fraud is perpetrated with a coin on a string followed by a second fraudulent coin, the second coin usually arrives at the accept sensor coils C4*a*, 4*b* at a time which falls outside of a normal time range which occurs for a true coin. Furthermore, if the coin on a string is lowered sufficiently to be sensed by the coin accept coils C4, it usually remains in the vicinity of the coils C4 for a longer or shorter time than occurs for a genuine coin and so the above mentioned tests can thereby distinguish between a true coin and an attempt to defraud the validator.

In order to check the various timings for the coin accept pulse $x_4$ developed by the coils C4*a*, C4*b*, the microprocessor 7 includes operational routines which define predetermined time periods following a successful primary validation test. Referring to FIG. 3A, the microprocessor 7 operates a routine known as an undertimer, which times out after a time $t_1$ following a successful primary validation test. A corresponding overtimer times out after a period $t_2$ shown in FIG. 3B following the successful primary validation test. If, as shown in FIG. 3C, the coin accept pulse $x_4$ occurs within a time window between $t_1$ and $t_2$, the coin meets the criteria for test a) and b) given above.

Also, the microprocessor 7 includes a routine which generates a clearance time period, which, as shown in FIG. 3D, is generated after a predetermined time interval following the occurrence of the leading edge of accept pulse $x_4$. If the trailing edge of the pulse $x_4$ falls within the time window $t_3$, $t_4$, namely $t_5$in FIG. 3D, this indicates that the coin has cleared the accept coils C4*a, b* within an acceptable time range, thus satisfying the criteria for auxiliary tests c) and d) given above.

Figure 4A:
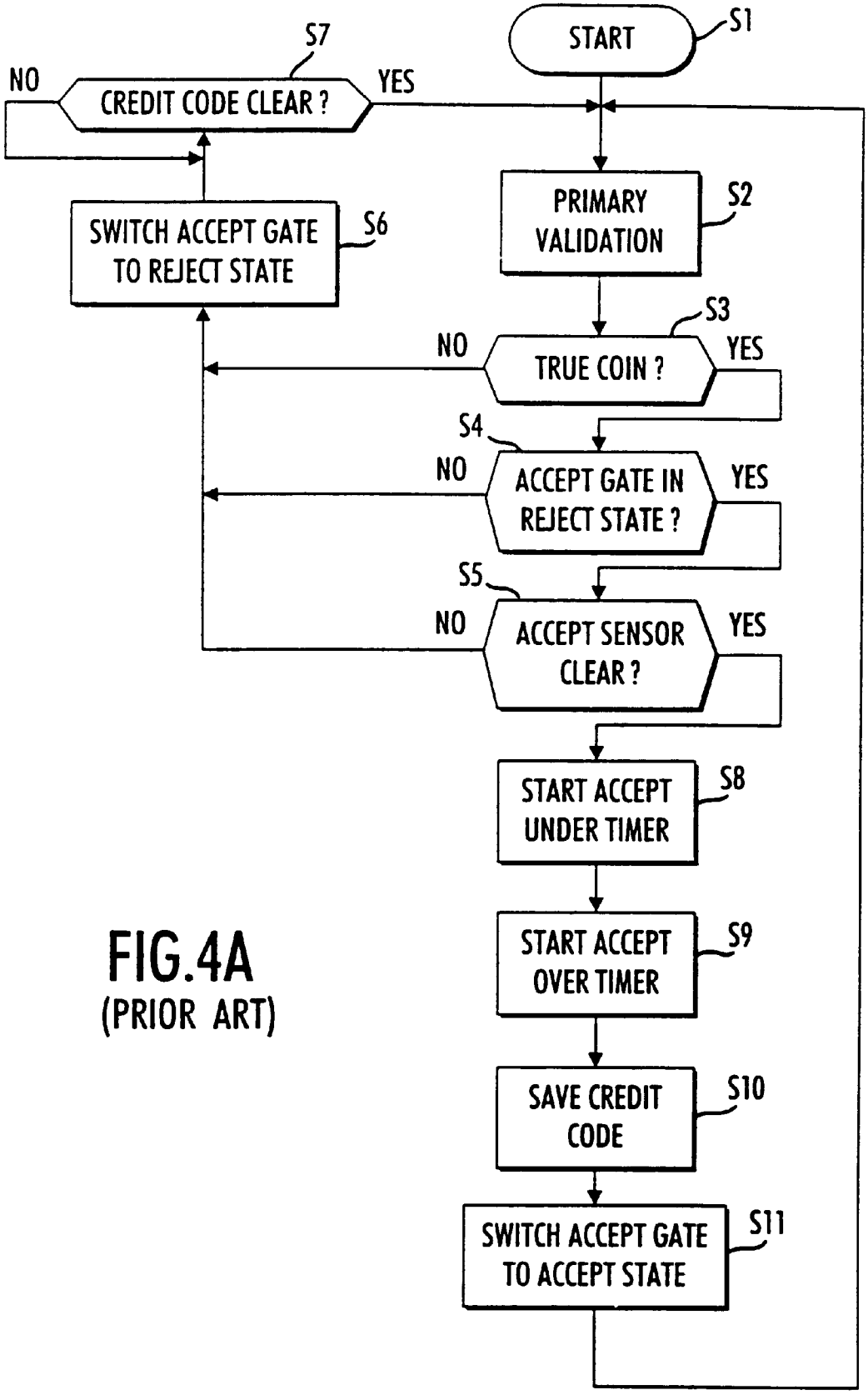
FIG.4A (PRIOR ART)
FIGS. 4A–4B illustrate a flow diagram illustrating operation of the microprocessor shown in FIG. 2, when performing primary and auxiliary validation testing according to a prior art method.

Referring now to FIG. 4, a flow diagram for the conventional primary and auxiliary tests will now be described. The process starts at step S1 and the primary coin validation (in response to a coin at sensor station 5) is carried out at step S2. At S3, if the primary validation at S2 indicates the coin to be a true coin, the status of the accept gate 11 is checked at step S4. If the gate 11 is in the reject state, i.e. no drive signal is applied on line 9 to the gate driver 10 so that the gate is open, a check is carried out a step S5 to determine whether a coin accept signal $x_4$ is being produced by the accept coil C4. Thus, the steps S4 and S5 check that any previously validated coin or fraud has been cleared through the validator. If the coin is not a true coin or the gate 11 is closed for the acceptance of a coin, or a coin remains in the vicinity of the accept coil arrangement C4, the routine at step S6 de-energises line 9 (FIG. 2) in order to open the gate 11 to place it in its reject state. At step S7, any credit code on line 14 is cleared to ensure that no credit is accumulated for the coin under test.

Referring back to steps S4 and S5, for the coin to be accepted as a true coin, the gate 11 must be initially open and the accept sensor coil C4 arrangement must be clear. In this case, the routine proceeds to steps S8 and S9 so as to start and undertimer and the overtimer (see FIGS. 3A and 3B). Also, at step S10, the value of the coin denomination for the true coin determined at step S2 is saved as a so-called credit code. At step S11, a drive signal is applied to line 9 (FIG. 2) to operate gate driver 10 and thereby switch the gate 11 to an accept state in which it is closed, so as to direct coins to the coin accept path 13 (FIG. 1).

Figure 4B:
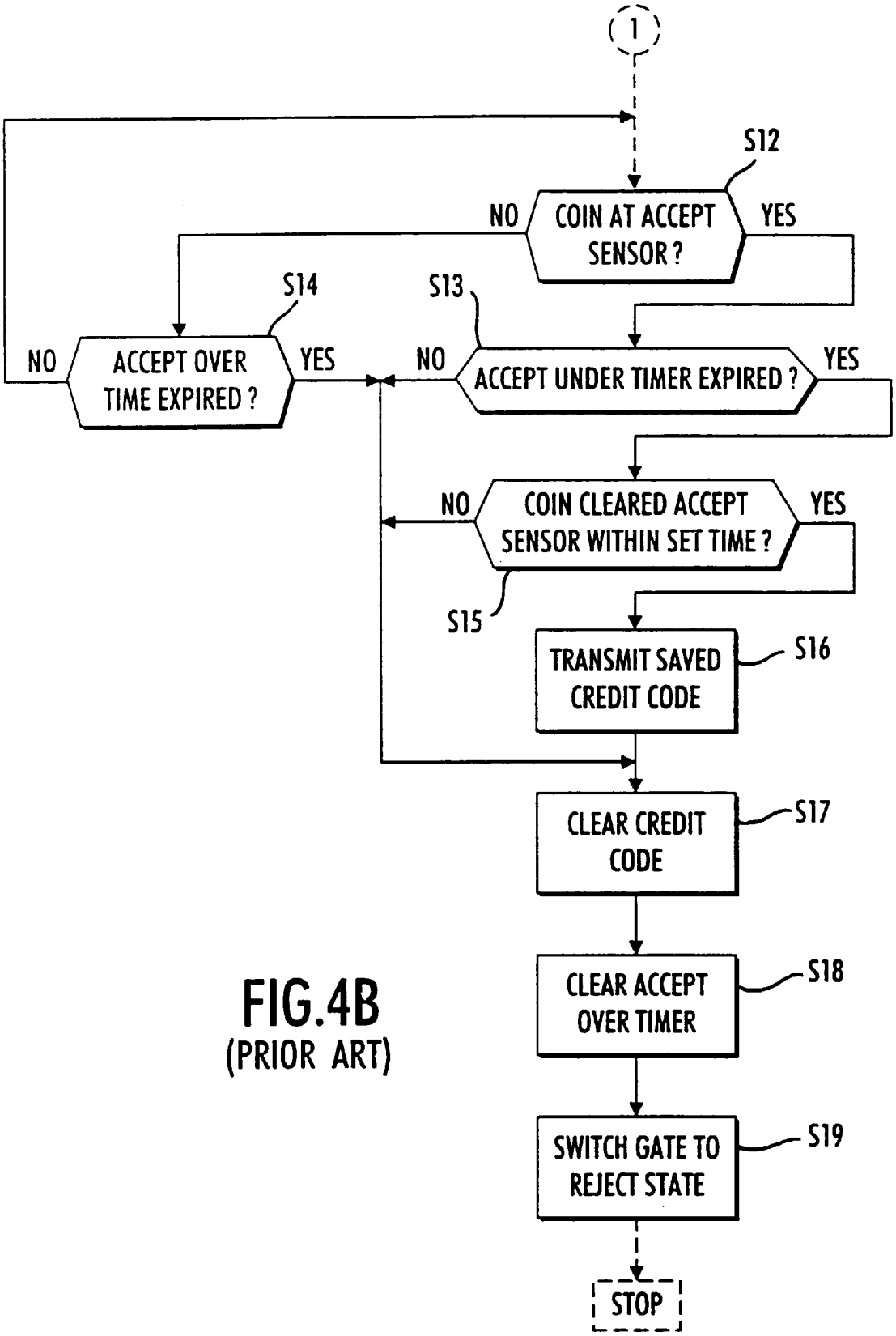
FIG.4B (PRIOR ART)

Referring to FIG. 4B, this shows an interrupt routine for performing the auxiliary validation test. The coin that was validated at step S2 travels along the passageway shown in FIG. 1 and, because the gate has been closed at step S11 (FIG. 4A) the coin moves towards the coin accept sensor coil arrangement C4*a, b* (FIG. 1). As a result, a coin accept pulse $x_4$ is produced and fed to the microprocessor. This is detected step S12 in FIG. 4B.

At steps S13 and S14, the timing of the accept pulse $x_4$ is compared with the time out periods $t_1$ and $t_2$ of the undertimer and overtimer (FIG. 3A, B). If the accept pulse $x_4$ falls in the interval between times $t_1$ and $t_2$, the routine moves to step S14 which determines whether the trailing edge of the accept pulse $x_4$ falls within the acceptable time range $t_3$ and $t_4$ shown in FIG. 3D, indicating that the coin has not dwelled for an unacceptably long or short time in the region of the accept coil C4 (FIG. 1). If the test of step S14 is passed, the credit code that was saved at step S10 is transmitted on line 14 FIG. 2) at step S16, indicating the successful outcome of both the primary and auxiliary validation tests.

However, if the outcome of steps S13 to 15 is unfavourable, the credit code is not transmitted and instead is cleared at step S17 so that no credit code is developed on line 14. Thereafter, the accept overtimer is cleared at step S18 (the undertimer will have cleared already) and the gate 11 is switched to its reject state at step S19.

Whilst this routine is very reliable and provides good discrimination against fraudulent operation, it has the disadvantage of slowing the response time of the validator and limits the rate at which coins can be fed into the input 2 (FIG. 1) and satisfactorily validated.

This can be understood by considering two coins passing in close succession along the coin rundown path 4 through the sensor station 5. If both coins are true coins, they will successively produce successful primary validation test outcomes at the sensor station 5. For the first coin, the primary validation at step S2 will have a successful outcome at S3, the gate 11 will be in its reject state at S4 and the accept sensor C4 will be clear at step S5, so that the first coin will be accepted and the routine will pass through steps S8 through to S16 to generate a corresponding credit code. However, the second coin, which is detected to be true at step S3, is rejected at step S4 because the accept gate 11 will not have been de-energised. This is because a drive signal will still be applied on line 9 (FIG. 2) to the gate driver so that the first coin can be accepted. It will be seen that the gate 11 is not switched to its reject state until step S19 in FIG. 4B. Furthermore, the second coin causes the gate 11 to be opened, through steps S4 and S6, thereby forcing the second coin to the reject path 11.

Figure 5A:
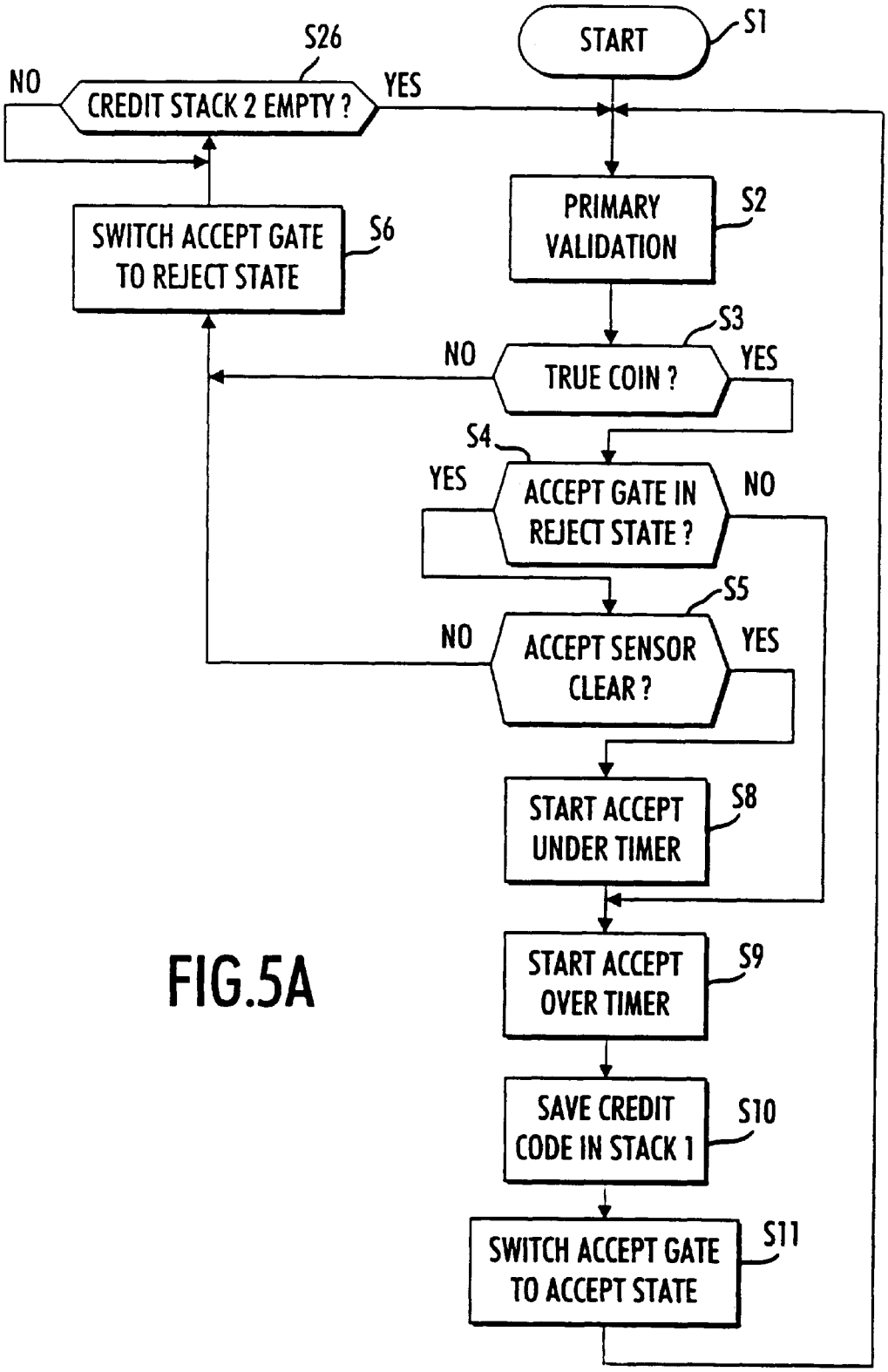
Figure 5B:
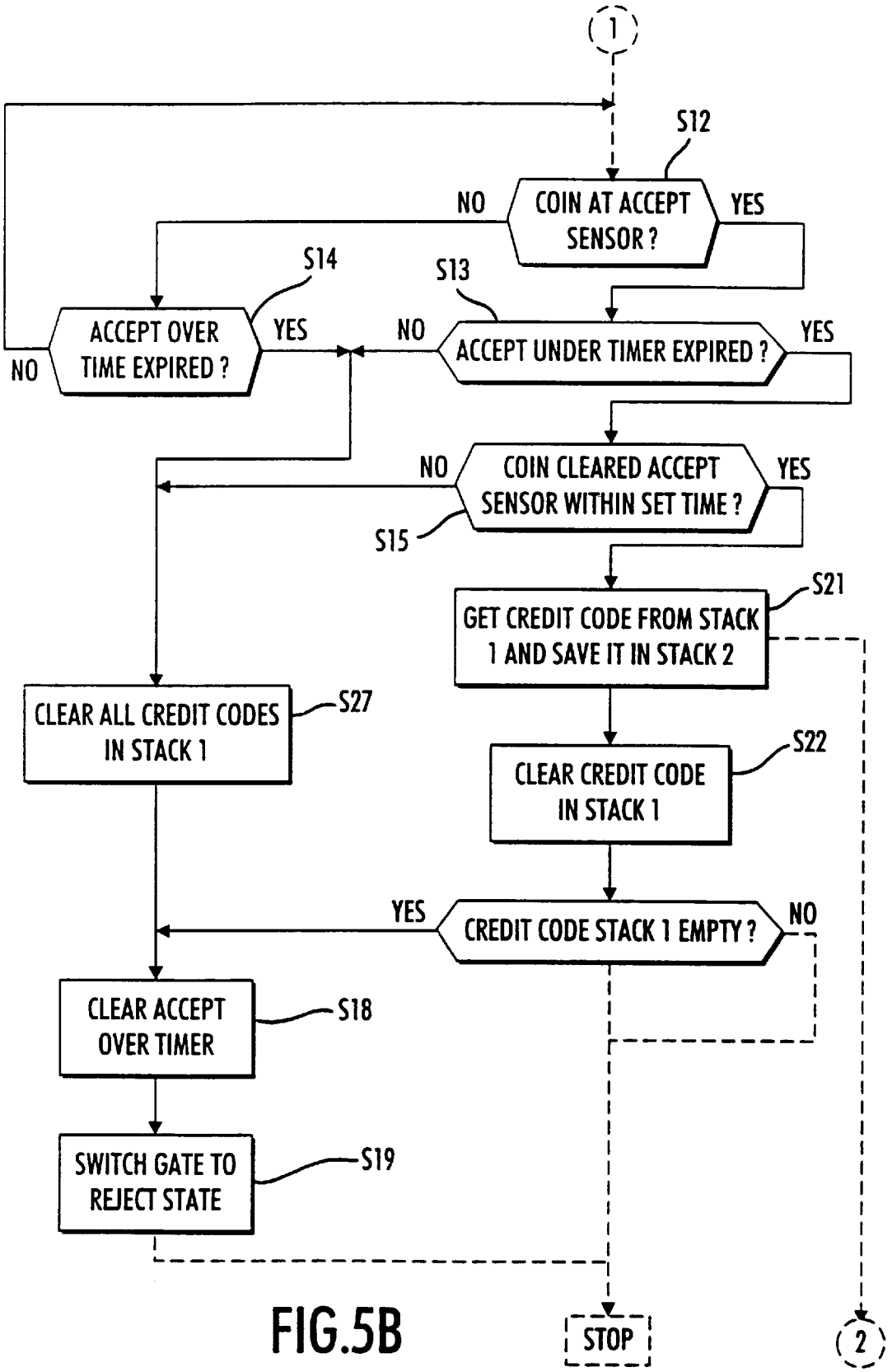

The present invention provides a solution to this problem by selectively switching off one or more of the auxiliary tests when the rate of coin entry for valid coins exceeds a given threshold. When coins are fed rapidly into the validator, it would be impossible to carry out a fraudulent operation with a coin on a string because there would be no time to insert and remove the fraudulent coin and in accordance with the invention, it has been appreciated that when the coin entry rate exceeds a given threshold, it is safe to discontinue with at least one or more of the auxiliary coin validation tests. An example of the invention will now be described in detail with reference to FIGS. 5A, B and C. In FIG. 5, FIG. 5A illustrates the main validation routine and FIGS. 5B and 5C illustrate interrupt routines which are commenced in response to each successful primary validation at step S2, the interrupt routines being linked to one another and to the primary routine as shown in the drawings. In this example, the undertimer is disabled when coins are fed into the validator at a rate greater than a given threshold.

When a first true coin is inserted into the validator, a successful outcome of the primary validation test performed at S2 is determined at S3. If the gate 11 is in its reject state and the accept sensor coil C4 is clear of coins, as determined at steps S4 and S5, the start accept undertimer is started at step S8 and the overtimer is started at step S9 as previously described.

The memory of the microprocessor 7 is operationally partitioned to provide first and second stacks for credit codes hereinafter referred to as Stack 1 and Stack 2. The credit code for the first coin produced by the coin validation at S2 is stored in Stack 1 during step S10. Thereafter, at step S11, the accept gate is switched to its accept state i.e. is closed in order to direct the coin to the accept path 13.

Referring to FIG. 5B, the first interrupt routine commences for the first coin at step S12 in order to determine when the coin reaches the accept sensor coil C4. If the coin produces an accept pulse $x_4$ between the times $t_1$, $t_2$ produced by the overtimer and undertimer as determined by steps S13 and 14, the routine moves to step S15 to determine whether the coin clears the sensor coil C4 within a clearance time. If this occurs, the routine moves to step S21 and the credit code stored at step S20 for the coin, is transferred into Stack 2, the code being deleted from Stack 1 at step S22.

The first coin is thus acceptable and referring to FIG. 5C, the second interrupt routine ensures that the credit code associated with the coin is transmitted on line 14 (FIG. 2). More particularly, credit codes in Stack 2 are successively transmitted on line 14 by firstly getting the credit code from Stack 2 during step S23, clearing the code at S24 and transmitting the code at step S25. Step S26 determines if the Stack 2 is empty, and if not the routine shown in FIG. 5C is repeated until it is fully clear.

Considering now a second coin inserted into the validator rapidly after the first coin. As previously explained, in the prior art routine, the second coin would be rejected at step S4 in FIG. 4A. However, referring to FIG. 5A, at step S4, if the accept gate 11 remains in the reject state due to the acceptance process for the first coin, the routine does not automatically reject the second coin but instead skips past the steps S5 and S8. The routine assumes that because the gate 11 is not yet in its reject state, the accept sensor coil C4 will not yet be clear because the acceptance process for the first coin has not yet been completed. Furthermore, in accordance with the invention, it has been appreciated that it is not necessary to start the accept undertimer (step S8) in this situation. Because the first and second coins are inserted in rapid succession, it would be impossible to perform a coin on a string type fraud and consequently, it is safe to disable the undertimer at step S8 in respect of the second coin.

Then, the credit code for the second coin produced during the second primary validation at S2, is stored at step S20 in Stack 1 and the accept gate 11 is maintained in its accept state at step S11.

Thereafter, the routine moves to step S12 (FIG. 5B). The undertimer will have already expired at step S13 because it has already expired due to the acceptance of the first coin and has not been restarted in response to the second coin. Therefore, as long as the overtimer has not expired before the coin reaches the accept sensor coil C4 (steps S12 and S14) the routine moves to step S15 for the second coin and the credit code for the second coin is transferred from Stack 1 to Stack 2 at step S21, as long as the second coin clears the sensor coil C4 within the predetermined clearance time as determined at step S15. The credit code for the second coin will thus be transmitted at step S25 by the routine shown in FIG. 5C, in the manner previously explained.

In the event that the overtimer times out before a coin reaches the accept sensor coil C4 (step S14) or in the event that the auxiliary test at step S15 is unsuccessful, the corresponding credit code for the coin concerned is cleared at step S27 from Stack 1. As a result, the code cannot be transferred to Stack 2 at step S21 because the coin has failed the auxiliary tests.

Thus, in accordance with the invention, the routine has the advantage that the second coin can be accepted notwithstanding the fact that it closely follows the first coin and the primary validation for the second coin occurs during the time that the gate 11 is closed in order to handle acceptance of the first coin.

There is no degradation of the quality of validation achieved by the primary validation test, and the security afforded by the auxiliary validation test is not compromised by switching off the undertimer because the second coin follows the first so rapidly that it would be impossible in the time available to perform a coin on a string type fraud.

Furthermore, if the time between successive coins insertion increases, the undertimer is automatically enabled again to ensure that the security provided by the auxiliary testing is maintained.

Many modifications and variations of the invention will be evident to those skilled in the art. For example, in the embodiment of FIG. 5, only one of the auxiliary coin validation tests is disabled when the coin entry rate exceeds a given threshold. It would be possible to disable further ones of the auxiliary tests depending on the coin entry rate. For example, although not shown it would be possible to disable operation of the overtimer at step S14 and/or the clearance time check that is performed at step S13. This could be done for example in dependence upon the outcome of the test at step S4. The auxiliary tests may be progressively disabled as the coin entry rate increases.

The routine may be extended to include further auxiliary validation tests such as the detection of coins travelling backwards through the validator and coins being detected at the accept sensor coil C4*a* when not expected.

It will be appreciated that the microprocessor can be rendered unresponsive to the outcome of the or each auxiliary validation test by either not performing the test itself or by disabling the outcome of the test in the relevant microprocessor routine.

As used herein the term "coin" includes a token or other like item of credit.

Whilst the described example of validator uses inductive sensors, optical or mechanical sensors could be used, either at the primary validation testing station, or for the further sensor.

I claim:

1. Coin validation apparatus comprising:

a passageway to receive coins under test;

a validation testing configuration operable to perform primary validation testing on coins passing along the passageway and auxiliary validation testing in addition to the primary validation testing;

a gate to direct coins determined to be valid to an acceptance path and coins determined to be invalid to a reject path;

a controller operable to control operation of the gate in dependence upon an outcome of the validation testing, the controller being responsive to the outcomes of both the primary and the auxiliary testing when a succession of coins is fed into the passageway at a rate that is less than a given threshold and the controller being responsive to the outcome of the primary validation testing but unresponsive to the outcome of the auxiliary validation testing when a succession of coins is fed into the passageway at a rate that exceeds the threshold.

2. Coin validation apparatus according to claim 1 including sensor means for sensing coins travelling along the passageway, said primary validation testing means being responsive to the sensor means for performing the primary validation testing.

3. Coin validation apparatus according to claim 2 wherein the sensor means comprises at least one inductor coil for forming an inductive coupling with the coin, and said primary validation testing means is operative to validate the coin in dependence upon the inductive coupling.

4. Coin validation apparatus according to claim 2 wherein the auxiliary validation testing means includes a further sensor, and means for determining the time at which a coin under test moves into proximity with the further sensor.

5. Coin validation apparatus according to claim 4 wherein the auxiliary validation testing means includes means for determining whether the coin under test arrives at the further sensor within a time less than a given threshold.

6. Coin validation apparatus according to claim 4 wherein the auxiliary validation testing means includes means for determining whether the coin under test arrives at the further sensor within a time greater than a given threshold.

7. Coin validation apparatus according to claim 4 wherein the auxiliary validation testing means includes means for determining whether the coin under test remains in the vicinity of the further sensor for a time less than a given threshold.

8. Coin validation apparatus according to claim 4 wherein the auxiliary validation testing means includes means for determining whether the coin under test remains in the vicinity of the further sensor for a time greater than a given threshold.

9. Coin validation apparatus according to claim 4 wherein the auxiliary validation testing means includes means for detecting the operational setting of the gate means.

10. Coin validation apparatus according to claim 9 wherein the control means is operative in response to a successful validation of a first coin followed by a successful outcome of the primary validation testing for a second subsequent coin to disable at least one of the auxiliary validation tests in dependence upon the operational setting of the gate means.

11. Coin validation apparatus according to claim 4 wherein the auxiliary testing means includes an over timer and an under timer for defining respective maximum and minimum permissible times for a coin under test to reach the further sensor after the primary validation testing, and the control means is operative to disable operation of the undertimer when successive coins are fed into the validator at a rate that exceeds said given threshold.

12. Coin validation apparatus according to claim 3 wherein the auxiliary validation testing means includes a further sensor, and means for determining the time at which a coin under test moves into proximity with the further sensor.

13. Coin validation apparatus according to claim 5 wherein the auxiliary validation testing means includes means for determining whether the coin under test remains in the vicinity of the further sensor for a time less than a given threshold.

14. Coin validation apparatus according to claim 6 wherein the auxiliary validation testing means includes means for determining whether the coin under test remains in the vicinity of the further sensor for a time less than a given threshold.

15. Coin validation apparatus according to claim 5 wherein the auxiliary validation testing means includes means for determining whether the coin under test remains in the vicinity of the further sensor for a time greater than a given threshold.

16. Coin validation apparatus according to claim 8 wherein the auxiliary validation testing means includes means for detecting the operational setting of the gate means.

17. A method of validating coins, comprising:

performing primary validation testing on coins passing along a passageway;

performing at least one auxiliary validation test on the coins additional to the primary validation testing;

directing coins determined to be valid to an acceptance path and coins determined to be invalid to a reject path in dependence upon the outcome of the primary and auxiliary validation testing; and responding to the outcomes of both the primary validation test and auxiliary validation test when a succession of coins is fed into the passageway at a rate that is less than a given threshold and responding to the outcome of the primary validation testing but disregarding the outcome of the auxiliary validation test when a succession of coins is fed into the passageway at a rate that exceeds the given threshold.

18. A method according to claim 17 wherein the auxiliary test is not performed when the coin feed rate exceeds said threshold.

19. A method according to claim 17 including performing the auxiliary test by monitoring a time duration which is a function of the time taken for a coin under test to move from the location at which the primary testing is performed to a location in the accept path.

20. A method according to claim 18 including performing the auxiliary test by monitoring a time duration which is a function of the time taken for a coin under test to move from the location at which the primary testing is performed to a location in the accept path.

21. Coin validation apparatus comprising:

a passageway to receive coins under test;

a validation testing configuration operable to perform primary validation testing on coins passing along the passageway and auxiliary validation testing on the coins in addition to the primary validation testing and wherein the validation testing configuration includes a further sensor and means for determining the time at which a coin under test moves into proximity with the further sensor;

gate means to direct coins determined to be valid to an acceptance path and coins determined to be invalid to a reject path;

a controller operable to control operation of the gate means in dependence upon the outcome of the primary and auxiliary validation testing performed by the primary and auxiliary testing means; and said controller unresponsive to the outcome of the auxiliary validation test when a succession of coins is fed into the passageway at a rate that exceeds a given threshold.

* * * * *